US012370433B2

(12) United States Patent
Kishino

(10) Patent No.: US 12,370,433 B2
(45) Date of Patent: Jul. 29, 2025

(54) BINDING FOR SLIDING BOARD

(71) Applicant: BEARX INC., Niigata (JP)

(72) Inventor: Daisuke Kishino, Niigata (JP)

(73) Assignee: BEARX INC., Niigata (JP)

( * ) Notice: Subject to any disclaimer, the term of this patent is extended or adjusted under 35 U.S.C. 154(b) by 0 days.

(21) Appl. No.: 18/475,809

(22) Filed: Sep. 27, 2023

(65) Prior Publication Data

US 2024/0216784 A1 Jul. 4, 2024

(30) Foreign Application Priority Data

Dec. 29, 2022 (JP) ..... 2022-212835

(51) Int. Cl.

| | |
|---|---|
| ***A63C 10/18*** | (2012.01) |
| ***A63C 10/14*** | (2012.01) |
| *A63C 10/06* | (2012.01) |
| *A63C 10/08* | (2012.01) |

(52) U.S. Cl.

CPC ..... *A63C 10/18* (2013.01); *A63C 10/14* (2013.01); *A63C 10/06* (2013.01); *A63C 10/08* (2013.01)

(58) Field of Classification Search

CPC ..... A63C 10/06; A63C 10/08; A63C 10/14; A63C 10/18

See application file for complete search history.

(56) References Cited

U.S. PATENT DOCUMENTS 5,826,910 A * 10/1998 Ricks ..... A63C 10/18 280/14.24
5,909,893 A * 6/1999 Keller ..... A63C 10/20 280/607
6,575,489 B1 * 6/2003 White ..... A63C 10/18 280/634
2003/0230870 A1 * 12/2003 Sabol ..... A63C 10/14 280/618
2006/0290105 A1 * 12/2006 Coing ..... A63C 10/18 280/617
2007/0290463 A1 * 12/2007 White ..... A63C 10/18 280/14.24

(Continued)

FOREIGN PATENT DOCUMENTS

EP 2745887 A1 * 6/2014 ..... A63C 10/18
FR 2 999 946 A1 6/2014

(Continued)

OTHER PUBLICATIONS

Translation for EP 2745887 (Year: 2014).*
Office Action issued May 22, 2025 in Japanese Application No. 2022-212835.

*Primary Examiner* — Brian L Swenson
(74) *Attorney, Agent, or Firm* — Sughrue Mion, PLLC

(57) ABSTRACT

A binding for a sliding board, the binding including a foot-securing body (1) for securing a foot, and an attachment fixture (10) for attaching the foot-securing body (1) to a sliding board (50), wherein the attachment fixture (10) is composed of a disc body (11) that is fastened to an upper surface of the sliding board (50), a hole section (2) formed in the foot-securing body (1) being non-rotatably fitted onto the disc body (11), and a restricting securing body (12) that links to the disc body (11) via the hole section (2) in the foot-securing body (1) to restrict and secure the foot-securing body (1).

18 Claims, 11 Drawing Sheets

(56) References Cited

U.S. PATENT DOCUMENTS

| | | | | |
|---|---|---|---|---|
| 2009/0174172 | A1* | 7/2009 | Fumagalli | A63C 10/26<br>280/611 |
| 2009/0194956 | A1* | 8/2009 | Holzer | A63C 10/18<br>280/14.24 |
| 2011/0254239 | A1* | 10/2011 | Jung | A63C 10/18<br>280/14.24 |

FOREIGN PATENT DOCUMENTS

| | | | |
|---|---|---|---|
| JP | 11-57110 | A | 3/1999 |
| JP | 2006-524526 | A | 11/2006 |
| JP | 2019-205787 | A | 12/2019 |

* cited by examiner

BINDING FOR SLIDING BOARD

TECHNICAL FIELD

The present invention relates to a binding for a sliding board.

BACKGROUND ART

In the past, the snowboard binding disclosed in, e.g., Patent Document 1 was proposed for securing a boot to a snowboard.

The aforementioned snowboard binding comprises a foot-securing body 61 for securing a foot, and an attachment fixture 62 for attaching the foot-securing body 61 to a snowboard 50, as shown in FIG. 10. The attachment fixture 62 is a circular plate-form body having fastening holes 62*a* conforming to screw holes 50*a* provided in an upper surface of the snowboard 50, the attachment fixture 62 being configured to be non-rotatably fitted into a hole section 61*a* formed in the foot-securing body 61. Fastening the attachment fixture 62 to the upper surface of the snowboard 50 using four screws 63 in a state in which the attachment fixture 62 has been fitted into the hole section 61*a* in the foot-securing body 61 results in a structure in which the foot-securing body 61 is sandwiched between the attachment fixture 62 and the snowboard 50 so as to be secured therein.

Because the angle at which the foot-securing body 61 is attached to the snowboard 50 differs according to the physique, skill level, and style of a snowboard rider, the attachment fixture 62 is configured to be fastened to the snowboard 50 via the screws 63 in a constant prescribed orientation and is provided with angle markings 64, and an inner peripheral part of the hole section 61*a* in the foot-securing body 61 is provided with an angle pointing part 65 for pointing to an angle marking 64. When the foot-securing body 61 is to be attached to the snowboard 50, adopting a state in which a desired angle of the angle markings 64 is pointed to by the angle pointing part 65 makes it possible to attach the foot-securing body 61 to the snowboard 50 at the desired angle.

However, when the angle at which the foot-fixing body 61 is attached to the snowboard 50 is to be adjusted after the foot-securing body 61 has been attached, all of the screws 63 are removed from the snowboard 50, the attachment fixture 62 is separated from the foot-securing body 61, and the angle between the foot-securing body 61 and the attachment fixture 62 (the angle at which the angle marking 64 is pointed to by the angle pointing part 65) is changed, after which the attachment fixture 62 is fastened to the snowboard 50 using all of the screws 63. In a scenario in which the angle at which the foot-fixing body 61 is attached to the snowboard 50 is frequently changed to correspond to numerous different people, such as at a rental shop for snowboards 50, it is highly inconvenient to rapidly adjust the attachment angle. The above-described structure is highly inconvenient not only when the angle at which the foot-fixing body 61 is attached to the snowboard 50 is adjusted indoors as described above but also when the attachment angle is adjusted outdoors (on a field for sliding).

Moreover, the binding for a sliding board disclosed in Patent Document 2 (referred to below as "prior-art example") was proposed in the prior art as well, this binding being designed to enable the angle at which a foot-securing body 71 is attached to a snowboard 50 to be easily and quickly adjusted.

The prior-art example comprises a foot-securing body 71 for securing a foot, and an attachment fixture for attaching the foot-securing body 71 to a snowboard 50, as shown in FIG. 11. The attachment fixture is composed of: a disc body 72 that is fastened to an upper surface of the snowboard 50, a hole section 71*a* formed in the foot-securing body 71 being non-rotatably fitted onto the disc body 72; and a restricting securing body 73 that is screwed together with the disc body 72 by being rotated, via the hole section 71*a* in the foot-securing body 71, to restrict and secure the foot-securing body 71. The foot-securing body 71 is provided with an angle guide 75, and the disc body 72 is provided with angle markings 74. The angle markings 74 are configured such that when the hole section 71*a* in the foot-securing body 71 is fitted onto the disc body 72 using the angle guide 75 as an indicator, the angle of the angle markings 74 for which the angle guide 75 is used as an indicator will be the angle at which the foot-securing body 71 is attached to the snowboard 50.

This configuration shall now be described in further detail. A pattern 72*a* of recesses and protrusions is provided to an outer peripheral surface of the disc body 72, and a pattern 71*a*' of recesses and protrusions that engages with the pattern 72*a* of recesses and protrusions is provided to the inner peripheral surface of the hole section 71*a* in the foot-securing body 71. The hole section 71*a* in the foot-securing body 71 is configured to be non-rotatably fitted onto the disc body 72.

The restricting securing body 73 is composed of: a base member 73*a* configured to be screwed together with the disc body 72; and a ring member 73*b* provided to a lower-surface portion of the base member 73*a* so as to be capable of rotating relatively therewith about the same center of rotation. The ring member 73*b* is provided with a pattern 73*b*' of recesses and protrusions that engages with a pattern 71*a*" of recesses and protrusions provided to the periphery of the hole section 71*a* in the foot-securing body 71. When a handle 73*a*' provided to the restricting securing body 73 is gripped and the restricting securing body 73 is rotated to be screwed together with the disc body 72, the ring member 73*b* is prevented from rotating due to the pattern 73*b*' of recesses and protrusions in the ring member 73*b* catching and engaging with the pattern 71*a*" of recesses and protrusions in the foot-fixing body 71. The base member 73*a* is configured to rotate until screwing concludes.

Therefore, in the prior-art example, the hole section 71*a* in the foot-securing body 71 is fitted onto the disc body 72 fastened to the upper surface of the snowboard 50, in which state the handle 73*a* is rotated to screw the restricting securing body 73 together with the disc body 72, whereby the foot-securing body 71 can be attached to the snowboard 50. During fitting of the hole section 71*a* in the foot-securing body 71 onto the disc body 72, the hole section 71*a* in the foot-securing body 71 is fitted onto the disc body 72 using the angle guide 75 on the foot-securing body 71 as an indicator for the angle markings 74 provided to the disc body 72, whereby the foot-securing body 71 can be attached at a desired angle to the snowboard 50.

Additionally, in the prior-art example, in a case where the angle at which the foot-securing body 71 is attached to the snowboard 50 is to be adjusted after the restricting securing body 73 has been attached, the handle 73*a* is rotated to remove the restricting securing body 73 from the disc body 72, the angle between the foot-securing body 71 and the disc body 72 (the angle at which the angle marking 74 is pointed to by the angle guide 75) is changed, and the handle 73*a* is rotated to screw the restricting securing body 73 together with the disc body 72, whereby the procedure concludes.

Because the restricting securing body 73 can be easily detached from the disc body 72 using an operation for rotating the handle 73*a* as described above, it is possible, in the prior-art example, for the angle at which the foot-securing body 71 is attached to the snowboard 50 to be easily and quickly adjusted.

PRIOR-ART LITERATURE

Patent Documents

[Patent Document 1] Domestic Republication No. 2006-524526

[Patent Document 2] French Patent Application Publication No. 2999946

DISCLOSURE OF THE INVENTION

Problems to be Solved by the Invention

However, in the prior-art example, the angle markings 74 are provided to an upper surface of the disc body 72, and because the angle markings 74 might be concealed when the restricting securing body 73 is screwed together with the disc body 72, a problem is presented in that, after the foot-securing body 71 has been attached to the snowboard 50 at a prescribed angle, the attachment angle cannot be confirmed unless the restricting securing body 73 is removed at each instance, thus making it impossible to confirm the current attachment angle at a glance.

The present invention was contrived in view of the above-described problem and provides an unprecedented and highly practical binding for a sliding board.

Means for Solving the Problems

The main points of the present invention are described below with reference to the accompanying drawings.

In a first aspect, the present invention pertains to a binding for a sliding board, the binding comprising a foot-securing body 1 for securing a foot, and an attachment fixture 10 for attaching the foot-securing body 1 to a sliding board 50, wherein the binding is characterized in that: the attachment fixture 10 is composed of a disc body 11 that is fastened to an upper surface of the sliding board 50, a hole section 2 formed in the foot-securing body 1 being non-rotatably fitted onto the disc body 11, and a restricting securing body 12 that links to the disc body 11 via the hole section 2 in the foot-securing body 1 to restrict and secure the foot-securing body 1; the disc body 11 is provided with an angle guide 3; the periphery of the hole section 2 in the foot-securing body 1 is provided with an angle display part 4; the angle display part 4 is configured such that when the hole section 2 in the foot-securing body 1 is fitted onto the disc body 11 using the angle guide 3 as an indicator, the angle of the angle display part 4 for which the angle guide 3 is used as an indicator will be the angle at which the foot-securing body 1 is attached to the sliding board 50; and the restricting securing body 12 is furthermore provided with an angle pointing part 5 for pointing to the angle display part 4.

In a second aspect, the present invention also pertains to the binding for a sliding board according to the first aspect, characterized in that the angle display part 4 is located on a peripheral edge of the hole section 2 and is provided at a position where the angle display part 4 is not concealed by the restricting securing body 12.

In a third aspect, the present invention also pertains to the binding for a sliding board according to either of the first and second aspects, characterized in that the restricting securing body 12 is composed of a base member 13 configured to be linked to the disc body 11 by being rotated, and a securing member 14 provided to the base member 13 so as to be capable of rotating relatively therewith about the same center of rotation, the securing member 14 being provided with the angle pointing part 5.

In a fourth aspect, the present invention also pertains to the binding for a sliding board according to the third aspect, characterized in that when the restricting securing body 12 is linked to the disc body 11 by being rotated, a rotation-preventing part 7 for preventing the securing member 14 from rotating is provided between the securing member 14 and the foot-securing body 1.

In a fifth aspect, the present invention also pertains to the binding for a sliding board according to the third aspect, characterized in that the periphery of the hole section 2 is provided with an annular step part 1*a* into which the securing member 14 is fitted, and an inner peripheral surface 1*a*' of the step part 1*a* is configured to be downwardly inclined toward the hole section 2.

In a sixth aspect, the present invention also pertains to the binding for a sliding board according to the fourth aspect, characterized in that the periphery of the hole section 2 is provided with an annular step part 1*a* into which the securing member 14 is fitted, and the inner peripheral surface 1*a*' of the step part 1*a* is configured to be downwardly inclined toward the hole section 2.

In a seventh aspect, the present invention also pertains to a binding for a sliding board, the binding comprising a foot-securing body 1 for securing a foot, and an attachment fixture 10 for attaching the foot-securing body 1 to a sliding board 50, wherein the binding is characterized in that: the attachment fixture 10 is composed of a disc body 11 that is fastened to an upper surface of the sliding board 50, a hole section 2 formed in the foot-securing body 1 being non-rotatably fitted onto the disc body 11, and a restricting securing body 12 that links to the disc body 11 via the hole section 2 in the foot-securing body 1 to restrict and secure the foot-securing body 1; the periphery of the hole section 2 in the foot-securing body 1 is provided with an angle guide 34; the disc body 11 is provided with a first angle display part 33; the first angle display part 33 is configured such that when the hole section 2 in the foot-securing body 1 is fitted onto the disc body 11 using the angle guide 34 as an indicator, the angle of the first angle display part 33 for which the angle guide 34 is used as an indicator will be the angle at which the foot-securing body 1 is attached to the sliding board 50; and the restricting securing body 12 is furthermore provided with a second angle display part 35 configured to display the same angle as the first angle display part 33 indicated by the angle guide 34.

In an eighth aspect, the present invention also pertains to the binding for a sliding board according to the seventh aspect, characterized in that the angle guide 34 is located on a peripheral edge of the hole section 2 and is provided at a position where the angle guide 34 is not concealed by the restricting securing body 12.

In a ninth aspect, the present invention also pertains to the binding for a sliding board according to either of the seventh and eighth aspects, characterized in that the restricting securing body 12 is composed of a base member 13 configured to be linked to the disc body 11 by being rotated, and a securing member 14 provided to the base member 13 so as to be capable of rotating relatively therewith about the same center of rotation, the securing member 14 being provided with the second angle display part 35.

In a tenth aspect, the present invention also pertains to the binding for a sliding board according to the ninth aspect, characterized in that when the restricting securing body 12 is linked to the disc body 11 by being rotated, a rotation-preventing part 7 for preventing the securing member 14 from rotating is provided between the securing member 14 and the foot-securing body 1.

In an eleventh aspect, the present invention also pertains to the binding for a sliding board according to the ninth aspect, characterized in that the periphery of the hole section 2 is provided with an annular step part 1*a* into which the securing member 14 is fitted, and an inner peripheral surface 1*a*' of the step part 1*a* is configured to be downwardly inclined toward the hole section 2.

In a twelfth aspect, the present invention also pertains to the binding for a sliding board according to the tenth aspect, characterized in that the periphery of the hole section 2 is provided with an annular step part 1*a* into which the securing member 14 is fitted, and the inner peripheral surface 1*a*' of the step part 1*a* is configured to be downwardly inclined toward the hole section 2.

Effects of the Invention

Due to being configured as described above, the present invention provides an unprecedented and highly practical binding for a sliding board in which the angle at which a foot-securing body is attached to a sliding board can be quickly adjusted, and moreover in which the angle at which the foot-securing body is attached to the sliding board can be confirmed at a glance from external appearance.

BEST MODE FOR CARRYING OUT THE INVENTION

Figure 1:
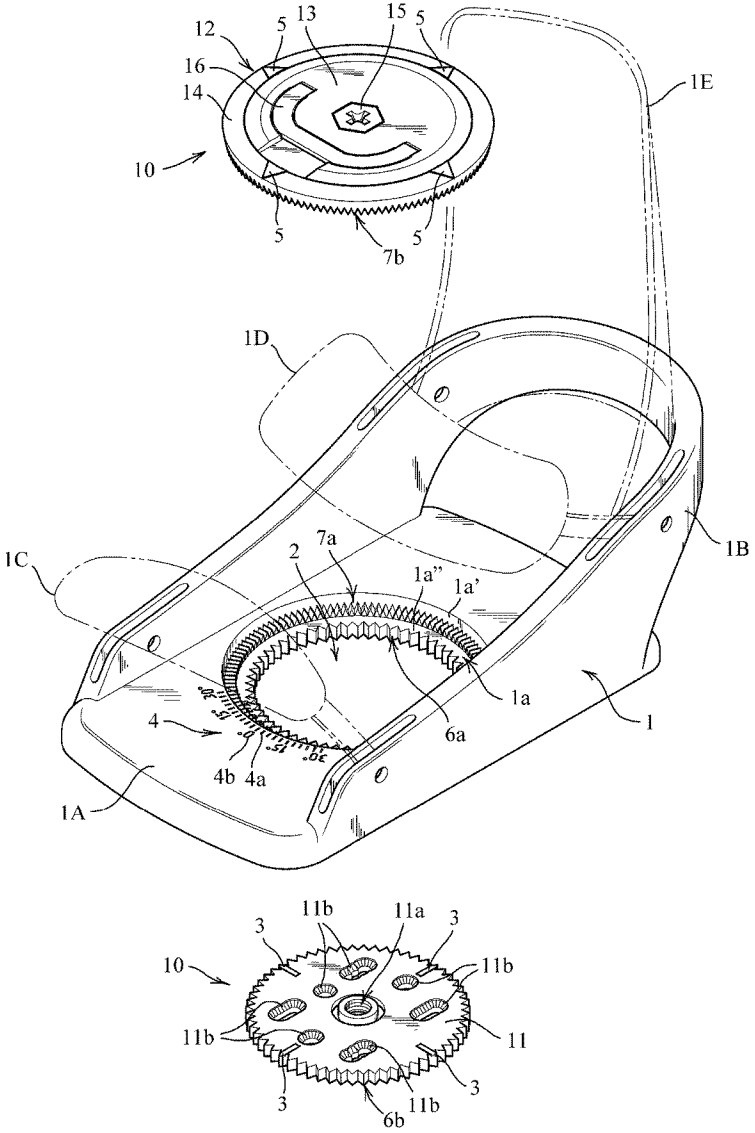
FIG. 1 is an exploded perspective view showing example 1.

Preferred embodiments of the present invention are briefly described below with reference to the drawings while indicating the effects of the present invention.

In the present invention, when, for example, a hole section 2 in a foot-securing body 1 is fitted onto a disc body 11 fastened to an upper surface of a sliding board 50, the foot-securing body 1 is incapable of rotating relative to the disc body 11, in which state a restricting securing body 12 is linked to the disc body 11, whereby the foot-securing body 1 is attached to the sliding board 50.

If angle guides 3 of the disc body 11 are employed as an indicator for an angle display part 4 on the foot-securing body 1 when the hole section 2 in the foot-securing body 1 is fitted onto the disc body 11, a desired angle of the angle display part 4 for which the angle guides 3 are used as an indicator will be the angle at which the foot-securing body 1 is attached to the sliding board 50. Additionally, when the restricting securing body 12 is linked to the disc body 11, the desired angle of the angle display part 4 for which the angle guides 3 are used as an indicator when fitting the hole section 2 in the foot-securing body 1 onto the disc body 11 will be pointed to by an angle pointing part 5 provided to the restricting securing body 12.

When the angle at which the foot-securing body 1 is attached to the sliding board 50 is to be adjusted, the restricting securing body 12 is removed from the disc body 11 to separate the foot-securing body 1, the hole section 2 in the foot-securing body 1 is subsequently fitted onto the disc body 11 in consideration that the angle at which the foot-securing body 1 is attached to the sliding board 50 is to be a desired angle according to the main points described previously, and then the restricting securing body 12 is linked to the disc body 11.

According to the present invention, the angle at which the foot-securing body 1 is attached to the sliding board 50 can be perceived from external appearance, and it is not necessary to, inter alia, remove the restricting securing body 12, as in the prior-art example described previously, to recognize the attachment angle.

EXAMPLES

Example 1

A specific example 1 of the present invention is described below with reference to the drawings.

The present example is a binding for a sliding board, the binding comprising a foot-securing body 1 for securing a foot, and an attachment fixture 10 for attaching the foot-securing body 1 to a sliding board 50.

The present example is applied to a snowboard that slides on the surface of snow, a snowboard boot worn by a snowboard rider being mounted on the foot-securing body 1, as the sliding board 50. However, the present example can also be applied to other structures, such as a snow ski, a wakeboard in which a foot is secured to a boot-shaped foot-securing body 1, or a water ski; other configurations can also be employed, as appropriate, provided that the features of the present example are exhibited.

Constituent portions according to the present example shall be described in detail below.

As shown in FIG. 1, the foot-securing body 1 is a mounting structure formed using appropriate synthetic-resin members, the mounting structure comprising a baseplate 1A, a heel cup 1B, a toe strap 1C, an ankle strap 1D, a highback 1E, and other basic structures for mounting snowboard boots.

The baseplate 1A of the foot-securing body 1 is provided with a hole section 2 that is circular in plan view.

The hole section 2 is formed passing through a central part of the baseplate 1A as shown in FIG. 1 and is set to a diameter allowing fitting onto the disc body 11 (described later).

An inner peripheral surface of the hole section 2 is provided with a jagged first pattern 6*a* of recesses and protrusions, in which acute peak-form protrusions and V-shaped recesses extend continuously with one another. When the hole section 2 is fitted onto the disc body 11, the first pattern 6*a* of recesses and protrusions engages with a second pattern 6*b* of recesses and protrusions provided to an outer peripheral end section of the disc body 11 to constitute a foot-securing-body-rotation-preventing part 6 for preventing the foot-securing body 1 from rotating relative to the disc body 11.

Adjacent protrusions in the first pattern 6*a* of recesses and protrusions are provided at angular intervals of 6°.

Therefore, when the hole section 2 in the foot-securing body 1 is fitted onto the disc body 11, the foot-securing body 1 is prevented from rotating by the foot-securing-body-rotation-preventing part 6. Moreover, rotating the foot-securing body 1 as appropriate in a state in which the foot-securing body 1 has been separated from the disc body 11 makes it possible to set the angle at which the foot-securing body 1 is attached to the sliding board 50 to a desired angle at six-degree intervals. This configuration may be modified such that the attachment angle can be set to angles at three-degree intervals or other intervals.

The periphery of the hole section 2 formed in the foot-securing body 1 (baseplate 1A) is also provided with a step part 1*a* that is annular in plan view (recessed step part), the step part 1*a* being provided in a connected row arrangement to the hole section 2 and being such that a securing member 14 of the restricting securing body 12 (described later) descends and is fitted thereinto.

Specifically, the step part 1*a* is composed of a horizontal bottom surface 1*a*" that is continuous with the inner peripheral surface of the hole section 2, and an inner peripheral surface 1*a*' formed extending upright from the bottom surface 1*a*" to an upper surface of the baseplate 1A. The inner peripheral surface 1*a*' of the step part 1*a* is configured to be downwardly inclined toward the hole section 2.

Therefore, a recessed site into which the restricting securing body 12 is fitted is formed in a tapered shape increasing in diameter toward the top, thus making it possible to satisfactorily perform an operation for fitting the restricting securing body 12.

The inner peripheral surface 1*a*' of the step part 1*a* is also provided with a jagged third pattern 7*a* of recesses and protrusions, in which acute peak-form protrusions and V-shaped recesses extend continuously with one another. When the restricting securing body 12 is fitted into the step part 1*a*, the third pattern 7*a* of recesses and protrusions engages with a fourth pattern 7*b* of recesses and protrusions provided to an outer peripheral end section of the restricting securing body 12 (securing member 14) to constitute a rotation-preventing part 7 for preventing the securing member 14 from rotating.

Therefore, when the restricting securing body 12 is fitted into the disc body 11, the securing member 14 of the restricting securing body 12 is prevented from rotating by the rotation-preventing part 7.

In the present example, adjacent protrusions in the third pattern 7*a* of recesses and protrusions are provided at angular intervals of 3°. Furthermore, the third pattern 7*a* of recesses and protrusions is provided in a state of being separated from the first pattern 6*a* of recesses and protrusions in the hole section 2 with the bottom surface 1*a*" of the step part 1*a* being interposed therebetween.

Additionally, the foot-securing body 1 is provided with the angle display part 4.

The angle display part 4 is configured such that when the hole section 2 in the foot-securing body 1 is fitted onto the disc body 11 (described later) using the angle guides 3 as an indicator, the angle of the angle display part 4 for which the angle guides 3 are used as an indicator will be the angle at which the foot-securing body 1 is attached to the sliding board 50.

Specifically, as shown in FIG. 1, the angle display part 4 is located on the peripheral edge of the hole section 2 and is provided at a position where the angle display part 4 is not concealed by the restricting securing body 12 (described later), the angle display part 4 being configured to display angle marking lines 4*a* and numeric characters 4*b*. The angle display part 4 may instead display only the angle marking lines 4*a* or display only the numeric characters 4*b*.

In the present example, an auxiliary angle display part 8 is located inward from the angle display part 4 and is provided to the bottom surface 1*a*" of the step part 1*a*.

The auxiliary angle display part 8 is configured such that when the hole section 2 in the foot-securing part 1 is fitted using the angle guides 3 provided to the disc body 11 as an indicator, the angle of the auxiliary angle display part 8 for which the angle guides 3 are used as an indicator will be the angle at which the foot-securing body 1 is attached to the sliding board 50.

Figure 5:
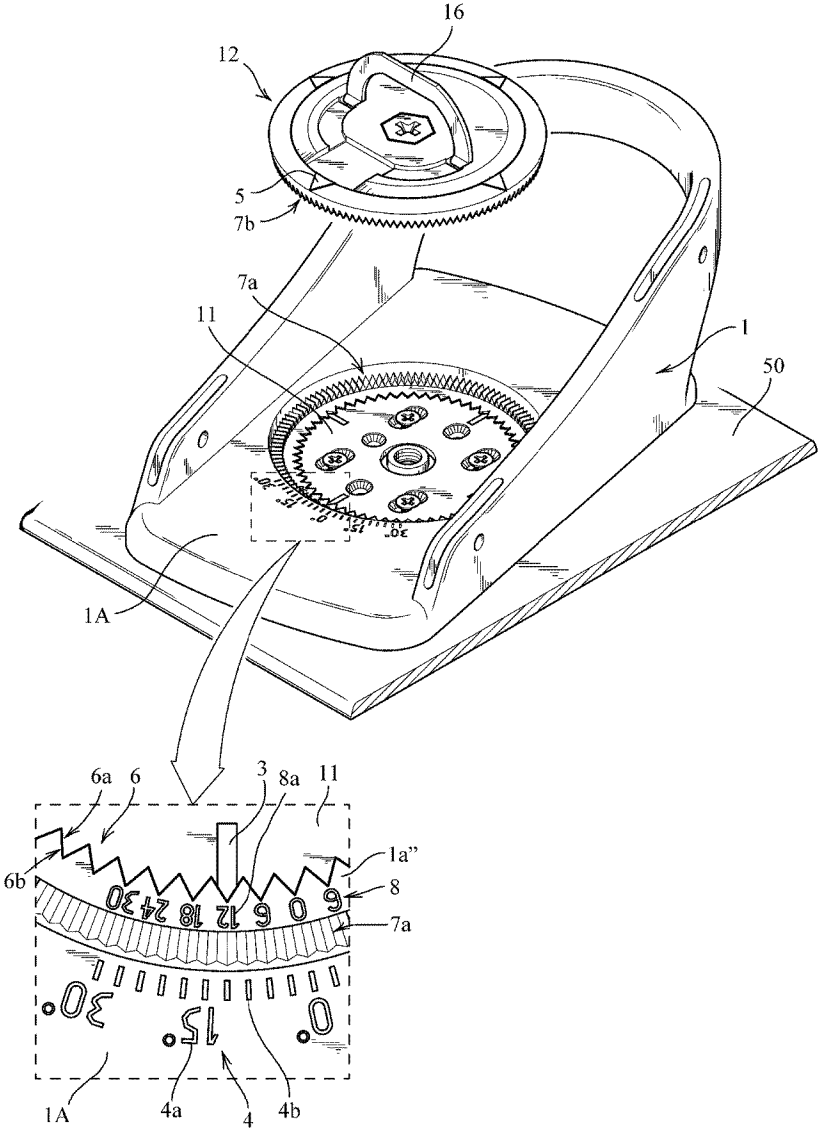
FIG. 5 is an illustrative diagram of the method for attaching example 1 to the sliding board 50.

Specifically, as shown in FIG. 5, the auxiliary angle display part 8 is configured such that numeric characters 8*a* for displaying angles are provided to the bottom surface 1*a*" of the step part 1*a*, which is at a position near the periphery of the hole section 2, and such that the same angle as that of the angle display part 4 indicated by the angle guides 3 is indicated. The auxiliary angle display part 8 may instead display only angle marking lines or display a combination of the numeric characters 8*a* and angle marking lines.

Therefore, although it is also permissible to use only the angle display part 4 described previously, using the auxiliary angle display part 8 makes it possible to match an angle more accurately due to the auxiliary angle display part 8 being located at a position closer to the angle guides 3 than that of the angle display part 4.

The attachment fixture 10 is configured from: the disc body 11, which is fastened to the upper surface of the sliding board 50, the hole section 2 formed in the foot-securing body 1 being fitted onto the disc body 11; and the restricting securing body 12 that links to the disc body 11 via the hole section 2 in the foot-securing body 1 to restrict and secure the foot-securing body 1.

As shown in FIG. 1, the disc body 11 is a circular plate-form body formed using an appropriate synthetic-resin member (nylon glass fiber). The outer peripheral end section of the disc body 11 is provided with the jagged second pattern 6*b* of recesses and protrusions, in which acute peak-form protrusions and V-shaped recesses extend continuously with one another. When the foot-securing body 1 is fitted onto the disc body 11, the second pattern 6*b* of recesses and protrusions engages with the first pattern 6*a* of recesses and protrusions provided to the foot-securing body 1 (inner peripheral surface of the hole section 2) to constitute the foot-securing-body-rotation-preventing part 6 for preventing the foot-securing body 1 from rotating relative to the disc body 11.

Adjacent protrusions in the second pattern 6*b* of recesses and protrusions are provided at angular intervals of 6° such that the second pattern 6*b* of recesses and protrusions engages at a desired angle with the first pattern 6*a* of recesses and protrusions described previously.

The disc body 11 is also provided with an internal threaded part 11*a* (cylindrical threaded hole section) in the central section thereof. The internal threaded part 11*a* is configured such that an external threaded part 15*a* (bolt part) of the restricting securing body 12 (described later) is screwed together therewith.

Figure 6:
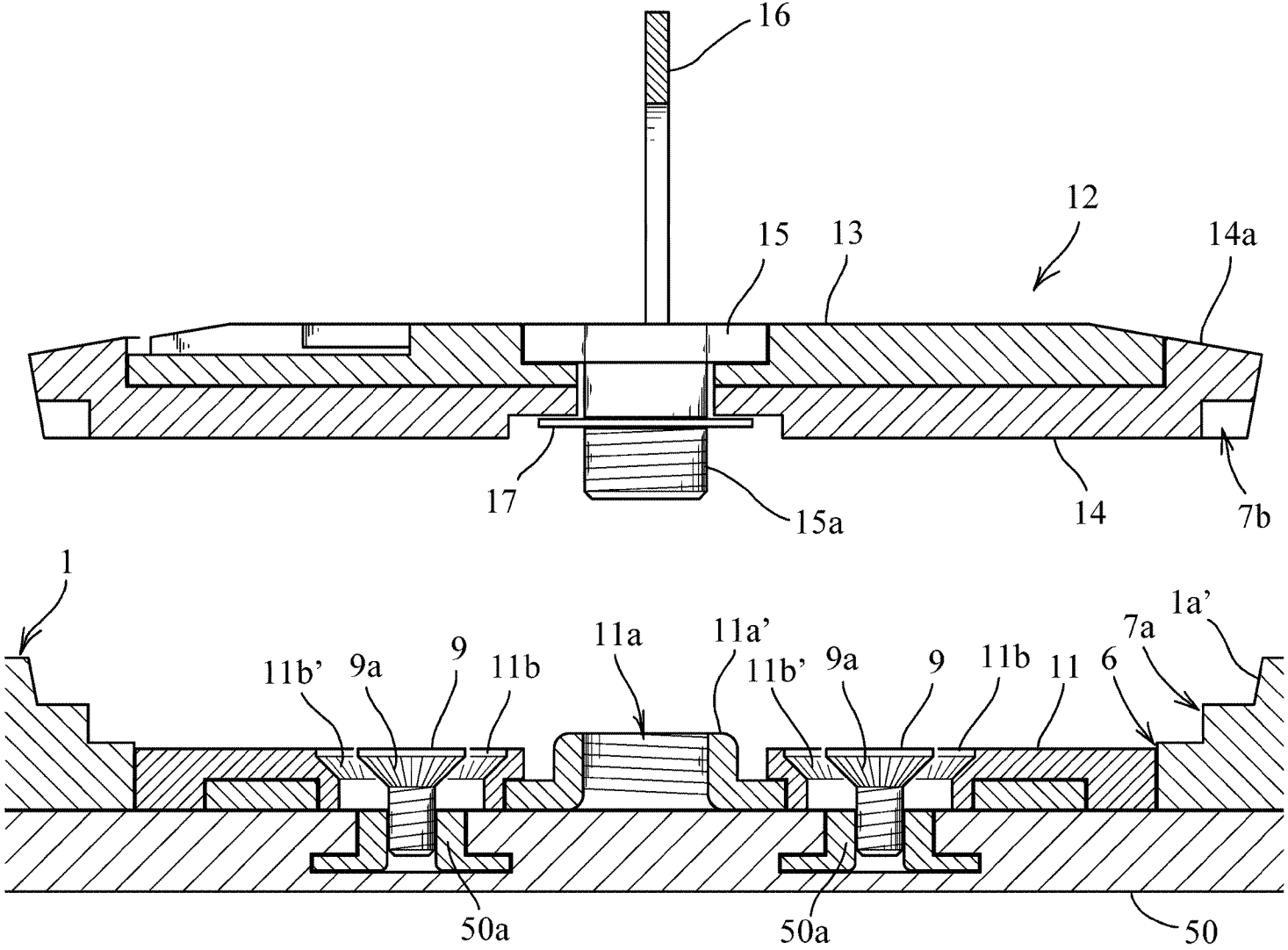
FIG. 6 is an illustrative cross-sectional diagram of the method for attaching example 1 to the sliding board 50.
Figure 7:
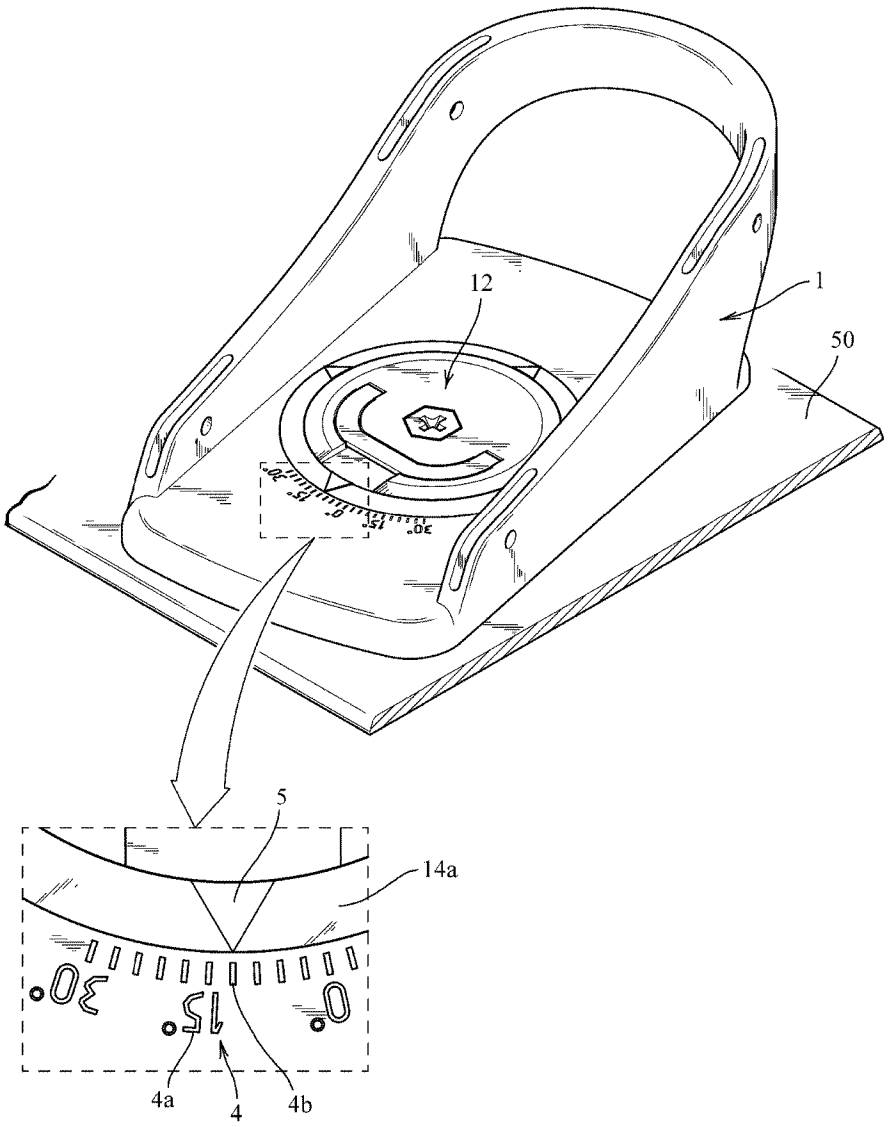
FIG. 7 is an illustrative diagram of the method for attaching example 1 to the sliding board 50.
Figure 8:
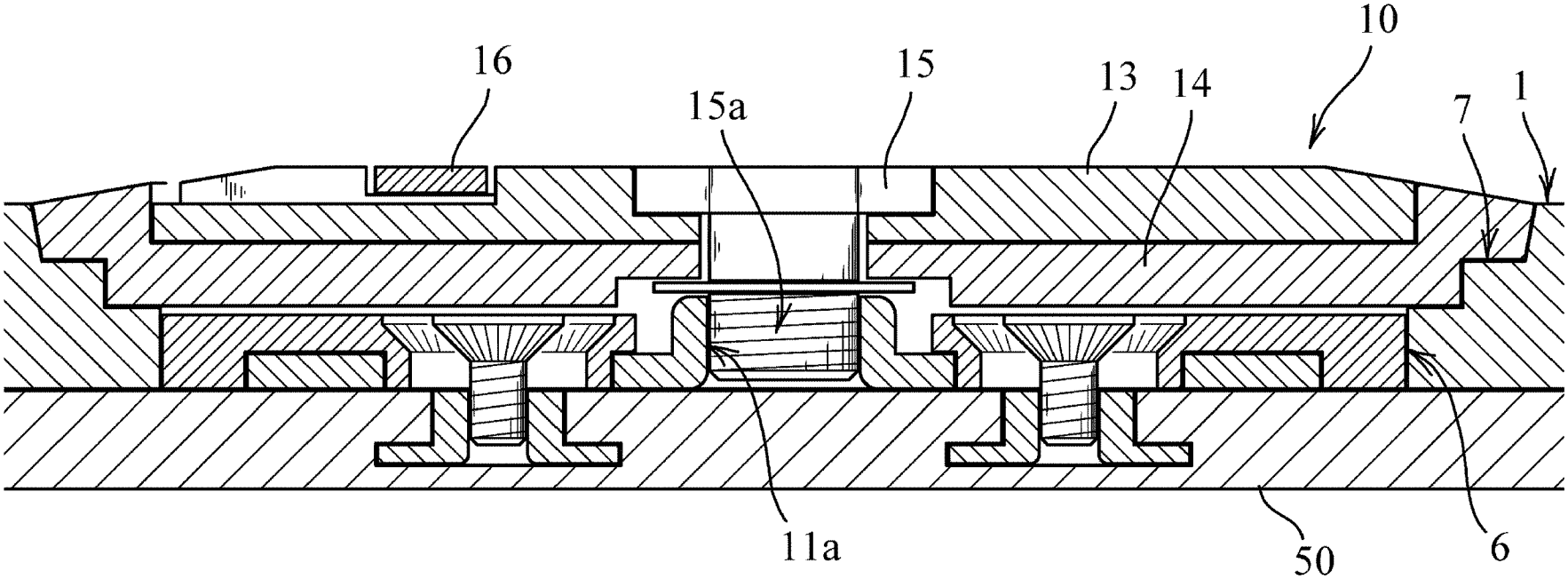
FIG. 8 is an illustrative cross-sectional diagram of the method for attaching example 1 to the sliding board 50.

The internal threaded part 11*a* is configured to be provided with a metal cylindrical member 11*a*' having a threaded hole. When another sliding board 50 is overlaid on the sliding board 50 in a state in which the disc body 11 is attached, an upper end section of the cylindrical member 11*a*' does not scratch the other sliding board 50 even if a sliding surface of the other sliding board 50 touches the cylindrical member 11*a*' (the cylindrical member 11*a*' is structured such that a chamfering or rounding process is implemented so that there are no angles at the peripheral edge of the upper end section) (refer to FIG. 6). It is also permissible to adopt a configuration in which the cylindrical member 11*a*' does not touch the sliding surface of the other sliding board 50 (a structure in which an upper end section of the internal threaded part 11*a* is flush with or sunken into the upper surface of the disc body 11).

Therefore, when the sliding board 50 is stored or transported in a state in which the disc body 11 has been attached to the sliding board 50, even if a plurality of sliding boards 50 are overlaid on one another, the sliding surface of the other sliding board 50 will be prevented from getting scratched.

A plurality of fastening holes 11*b* used when fastening the disc body 11 using screws 9 in screw holes 50*a* (insert holes) provided in the upper surface of the sliding board 50 are provided to the periphery of the internal threaded part 11*a*. The fastening holes 11*b* are configured to allow placement of a metal internal threaded member.

In the present example, the fastening holes 11*b* are set to a position, quantity, and form corresponding to a plurality of types of fastening methods that differ depending on the sliding board 50. Specifically, four long-hole-shaped fastening holes 11*b* and three circular fastening holes 11*b* are provided, and the fastening holes 11*b* are configured to correspond to: a type in which fastening is performed using the four long-hole-shaped fastening holes 11*b* and four screws 9; a type in which fastening is performed using two circular fastening holes 11*b* and two screws 9; and a type in which fastening is performed using two long-hole-shaped fastening holes 11*b*, one circular fastening hole 11*b*, and three screws 9. When fastening is performed using the four long-hole-shaped fastening holes 11*b*, the attachment position on the disc body 11 in a direction orthogonal to the longitudinal direction of the sliding board 50 can be changed as appropriate to adjust the center position of the foot-securing body 1 (the foot of a snowboard rider).

A locking protrusion rib 11*b*' is formed on the inner surface of each of the fastening holes 11*b*. Lower surfaces of head parts of the screws 9, which contact the inner surfaces of the fastening holes 11*b*, are provided with engaging protruding ribs 9*a* for engaging with the locking protrusion ribs 11*b*' when the screws 9 are fastened into the fastening holes 11*b*.

Therefore, when the screws 9 are screwed into the fastening holes 11*b*, the engaging protrusion ribs 9*a* engage with the locking protrusion ribs 11*b*', making it possible to perform solid fastening such that loosening does not readily occur.

The disc body 11 is also provided with the angle guides 3.

As shown in FIG. 1, the angle guides 3 are formed on the peripheral edge of the upper surface of the disc body 11 and are configured such that linearly shaped portions having acute sections are provided at four locations at intervals of 90°. The angle guides 3 may instead be triangular, arrow-shaped, or another shape.

The angle guides 3 are configured such that when the disc body 11 is fastened to the sliding board 50, the angle guides 3 provided at opposing positions on the front and rear are provided in a state of facing the same direction as the longitudinal direction of the sliding board 50, and the angle guides 3 provided at opposing positions on the left and right are provided in a state of facing a direction orthogonal to the longitudinal direction of the sliding board 50, and such that when the hole section 2 in the foot-securing body 1 is fitted onto the disc body 11, the angle guides 3 will serve as indicators for the angle display part 4 and the auxiliary angle display part 8 described previously.

As shown in FIG. 1, the restricting securing body 12 is composed of a base member 13 configured to be rotated to thereby link to the disc body 11, and a securing member 14 provided to the base member 13 so as to be capable of rotating relatively therewith about the same center of rotation.

Figure 2:
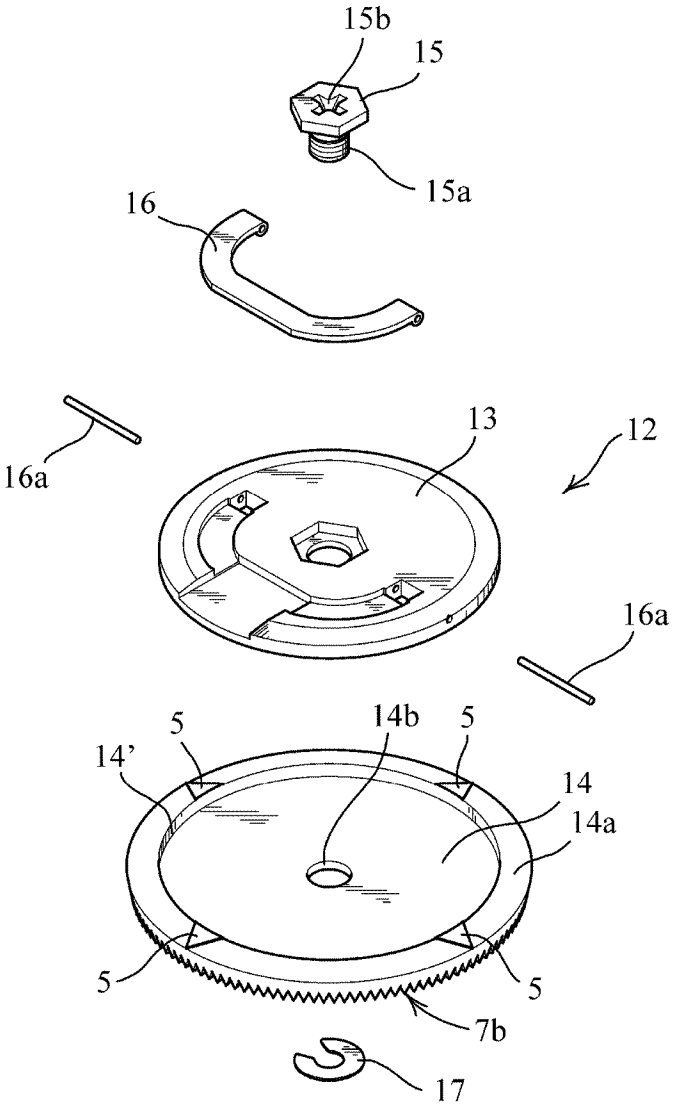
FIG. 2 is an exploded perspective view illustrating the main parts of example 1.
Figure 3:
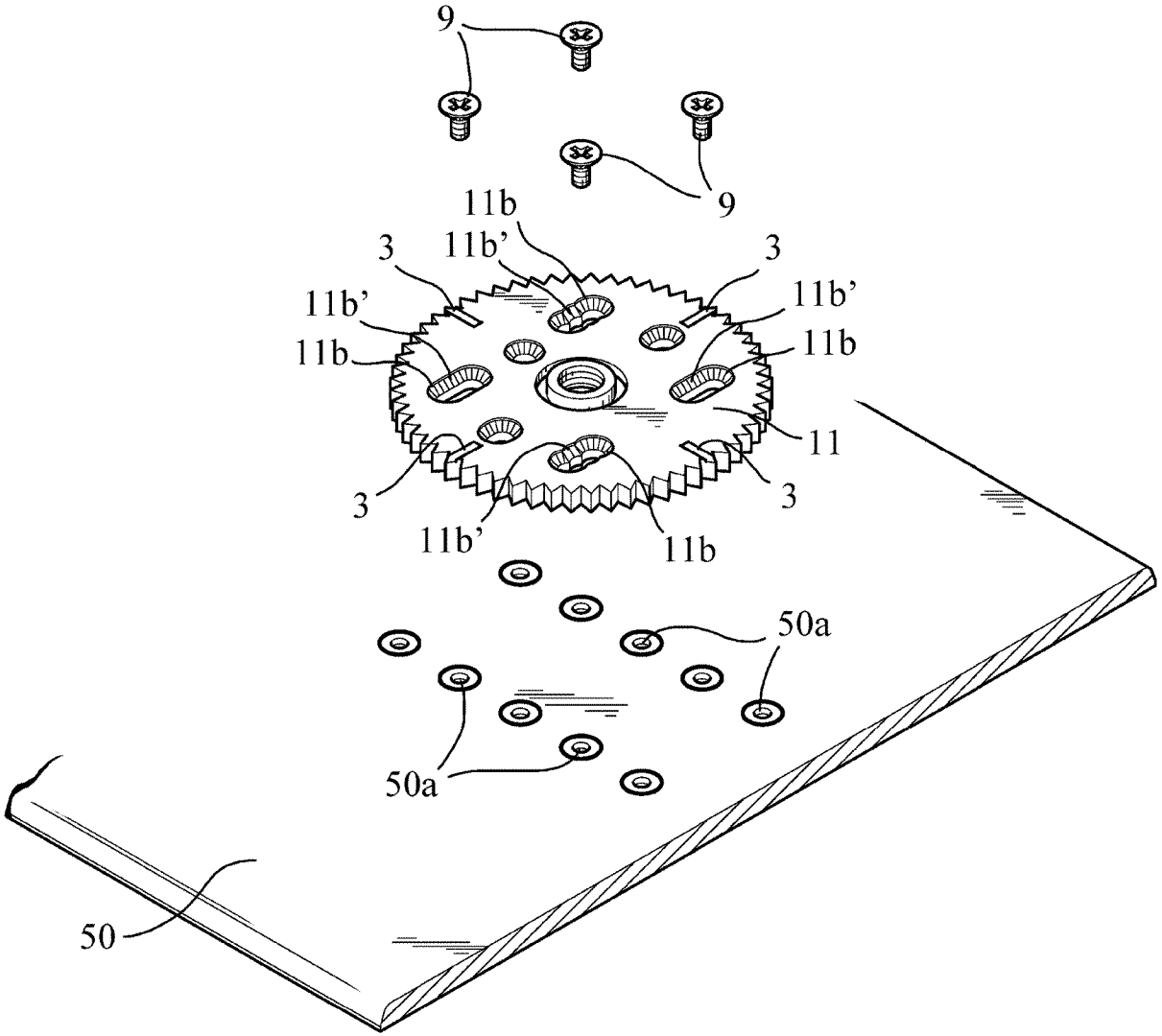
FIG. 3 is an illustrative diagram of a method for attaching example 1 to a sliding board 50.
Figure 4:
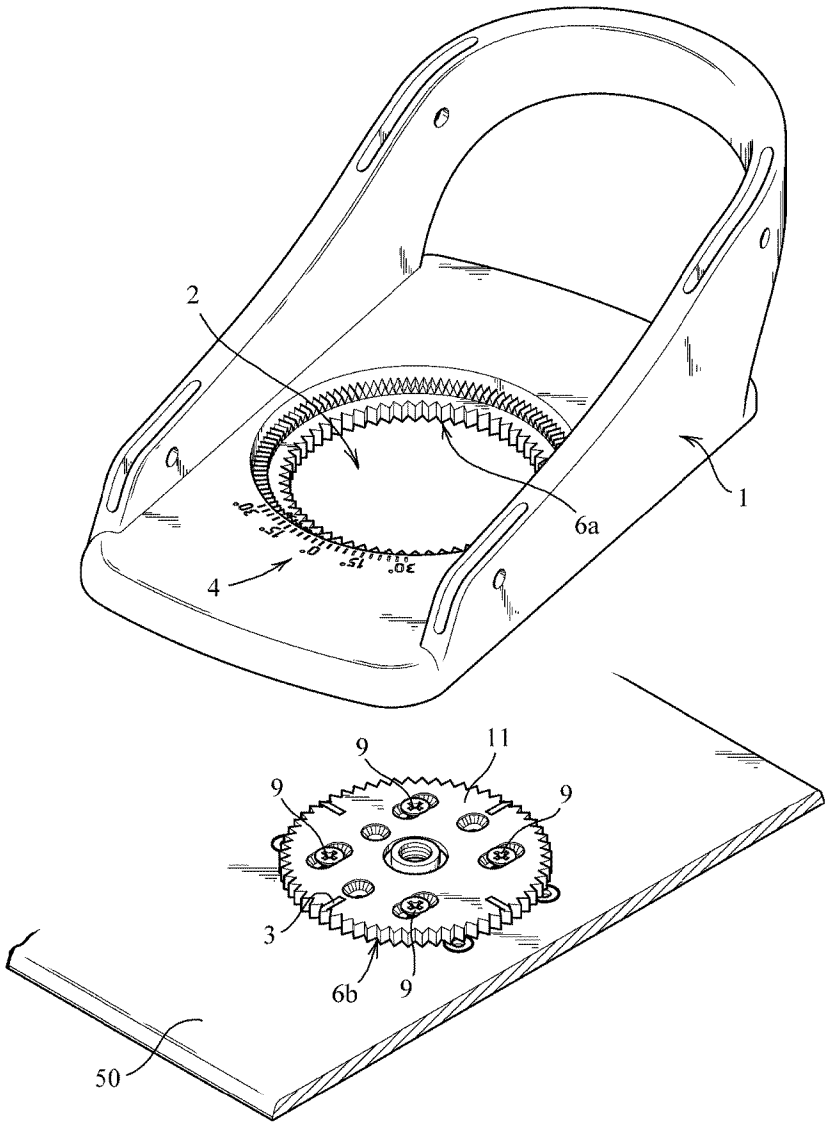
FIG. 4 is an illustrative diagram of the method for attaching example 1 to the sliding board 50.

Specifically, the base member 13 is a circular plate-form body formed using an appropriate metal member as shown in FIG. 2. A threaded member 15 (bolt member) is provided to a central section of the base member 13 in a non-rotatable state so as to pass through from an upper section toward a lower section. The threaded member 15 is provided in a state of projecting from a lower surface of the securing member 14 (described later) and is configured as the external threaded part 15*a* to be screwed into the internal threaded part 11*a* in the disc body 11 described previously.

Therefore, the restricting securing body 12 can be screwed together with the disc body 11 by being rotated.

As described previously, the restricting securing body 12 is not limited to a structure for rotating to thereby link to the disc body 11 (a screwed-together structure); for example, the restricting securing body 12 may have a "one-touch" structure in which a locking protuberance is made movable and then detachably linked through a restriction operation.

Additionally, an arch-shaped handle 16 is provided to an upper surface of the base member 13 so as to be capable of being raised and lowered.

Therefore, it is possible to grip the handle 16 to rotate the restricting securing body 12 when attaching to or detaching from the disc body 11. Moreover, the restricting securing body 12 can also be rotated using a tool (manual or electric screwdriver) by using a groove 15*b* (bit-fitting groove) in the head part of the threaded member 15. Reference symbol 16*a* refers to a pivot shaft about which the handle 16 pivots.

As shown in FIG. 2, the securing member 14 is a circular plate-form body formed using an appropriate synthetic-resin member (nylon glass fiber). An outer peripheral surface of the securing member 14 is formed as an inclined surface conforming to the downward incline on the inner peripheral surface 1*a*' of the step part 1*a* of the foot-securing body 1.

The securing member 14 is provided with a hole 14*b* passing through a central section so as to enable the threaded member 15 provided to the base member 13 described previously to rotate.

Therefore, a part of the threaded member 15 where a thread groove has been formed will project outward in a central section of a lower surface of the restricting securing body 12, the thread groove formation part being the external threaded part 15*a* to be screwed into the internal threaded part 11*a* in the disc body 11.

An upper surface of the securing member 14 is provided with a recessed part 14' into which the base member 13 is fitted and placed so as to be capable of rotating relatively therewith about the threaded member 15. The securing member 14 has an annular surrounding part 14*a* that surrounds the outer periphery of the base member 13 and is exposed as seen from the planar direction when the base member 13 has been fitted and placed. The angle pointing part 5 is provided to an upper surface of the surrounding part 14*a*.

As shown in FIG. 1, the angle pointing part 5 is configured such that triangular sections are provided to four locations at intervals of 90° on the upper surface of the surrounding part 14*a* and is configured to point to the angle display part 4 of the foot-securing body 1. The angle pointing part 5 may instead be a linear shape having an acute section, arrow-shaped, or another shape.

The peripheral end section on the lower surface of the securing member 14 (a position below the surrounding part 14*a*) is provided with the jagged fourth pattern 7*b* of recesses and protrusions, in which acute peak-form protrusions and V-shaped recesses extend continuously with one another. When the restricting securing body 12 is fitted into the step part 1*a* of the foot-securing body 1, the fourth pattern 7*b* of recesses and protrusions engages with the third pattern 7*a* of recesses and protrusions provided to the step part 1*a* to constitute the rotation-preventing part 7 for preventing the securing member 14 from rotating.

Adjacent protrusions in the fourth pattern 7*b* of recesses and protrusions are provided at angular intervals of 3° such that the fourth pattern 7*b* of recesses and protrusions engages at a desired angle with the third pattern 7*a* of recesses and protrusions described previously.

Therefore, when the restricting securing body 12 is fitted into the disc body 11 and rotated, the securing member 14 is prevented from rotating by the rotation-preventing member 7, only the base member 13 is rotated until screwing concludes, and a state in which the angle display part 4 is pointed to by the angle pointing part 5 is maintained. The securing member 14 is sandwiched between the base member 13 and the foot-securing body 1, whereby the securing member 14 also exhibits a function as a "washer."

Reference symbol 17 refers to a C-shaped ring for preventing the threaded member 15 from falling out to fasten the threaded member 15.

Because the present example is configured as described above, the foot-securing body 1 is incapable of rotating relative to the disc body 11 when the disc body 11 is fastened to the upper surface of the sliding board 50 and the hole section 2 in the foot-securing body 1 is fitted onto the disc body 11 fastened to the upper surface of the sliding board 50. Screwing the restricting securing body 12 together with the disc body 11 in this state attaches the foot-securing body 1 to the sliding board 50.

If the angle guides 3 of the disc body 11 are employed as an indicator for the angle display part 4 and the auxiliary angle display part 8 of the foot-securing body 1 when the hole section 2 in the foot-securing body 1 is fitted onto the disc body 11, a desired angle of the angle display part 4 and the auxiliary angle display part 8 (the same angle) indicated by the angle guides 3 will be the angle at which the foot-securing body 1 is attached to the sliding board 50. Additionally, when the restricting securing body 12 is screwed together with the disc body 11, the desired angle of the angle display part 4 and the auxiliary display part 8 for which the angle guides 3 are used as an indicator when the hole section 2 of the foot-securing body 1 has been fitted onto the disc body 11 will be pointed to by the angle pointing part 5 provided to the restricting securing body 12 (securing member 14). Because the restricting securing body 12 is screwed onto the disc body 11 due to rotation of only the base member 13, and the securing member 14 is prevented from rotating, the pointing by the angle pointing part 5 is maintained.

Additionally, when the angle at which the foot-securing body 1 is attached to the sliding board 50 is to be adjusted, the restricting securing body 12 is removed from the disc body 11 to separate the foot-securing body 1, the hole section 2 in the foot-securing body 1 is then fitted onto the disc body 11 in consideration that the angle at which the foot-securing body 1 is attached to the sliding board 50 is to be a desired angle according to the main points described previously, and then the restricting securing body 12 is screwed together with the disc body 11.

In the present example, the angle at which the foot-securing body 1 is attached to the sliding board 50 can be perceived from external appearance, and it is not necessary to, inter alia, remove the restricting securing body 12, as in the prior-art example described previously, to recognize the attachment angle.

Thus, according to the present example, the angle at which the foot-securing body 1 is attached to the sliding board 50 can be quickly adjusted, and moreover, the angle at which the foot-securing body 1 is attached to the sliding board 50 can be confirmed at a glance from external appearance.

In the present example, because the angle display part 4 is located on the peripheral edge of the hole section 2 and is provided at a position where the angle display part 4 is not concealed by the restricting securing body 12, the effect described previously can be reliably realized.

Additionally, in the present example, because the restricting securing body 12 is composed of the base member 13 configured to be rotated to thereby link to the disc body 11, and the securing member 14 provided to the base member 13 so as to be capable of rotating relatively therewith about the same center of rotation, and because the securing body 14 is provided with the angle pointing part 5, the effect described above can be reliably realized with regard to this feature as well.

Additionally, in the present example, because the rotation-preventing part 7 for preventing the securing member 14 from rotating is provided between the securing member 14 and the foot-securing body 1 when the restricting securing body 12 is rotated and thereby linked to the disc body 11, the state in which the angle display part 4 is pointed to by the angle pointing part 5 can be maintained even when the restricting securing body 12 is rotated.

Additionally, in the present example, because the periphery of the hole section 2 is provided with the annular step part 1*a* into which the securing member 14 is fitted, and because the inner peripheral surface 1*a'* of the step part 1*a* is configured to be downwardly inclined toward the hole section 2, the restricting securing body 12 can be satisfactorily fitted and placed relative to the foot-securing body 1.

Example 2

A specific example 2 of the present invention is described below with reference to the drawings.

The present example is a binding for a sliding board, the binding comprising a foot-securing body 1 for securing a foot, and an attachment fixture 10 for attaching the foot-securing body 1 to a sliding board 50, wherein: the attachment fixture 10 is composed of a disc body 11 that is fastened to the upper surface of the sliding board 50, a hole section 2 formed in the foot-securing body 1 being non-rotatably fitted onto the disc body 11, and a restricting securing body 12 that links to the disc body 11 via the hole section 2 in the foot-securing body 1 to restrict and secure the foot-securing body 1; the periphery of the hole section 2 in the foot-securing body 1 is provided with an angle guide 34; the disc body 11 is provided with a first angle display part 33; the first angle display part 33 is configured such that when the hole section 2 in the foot-securing body 1 is fitted using the angle guide 34 of the disc body 11 as an indicator, the angle of the first angle display part 33 for which the angle guide 34 is used as an indicator will be the angle at which the foot-securing body 1 is attached to the sliding board 50; and the restricting securing body 12 is furthermore provided with a second angle display part 35 configured to display the same angle as the first angle display part 33 indicated by the angle guide 34.

Specifically, the foot-securing body 1 is provided with the angle guide 34, the disc body 11 is provided with the first angle display part 33, and the restricting securing body 12 is provided with the second angle display part 35. The angle guide and the angle display parts are thus provided in a relationship opposite that in embodiment 1 described previously.

Figure 9:
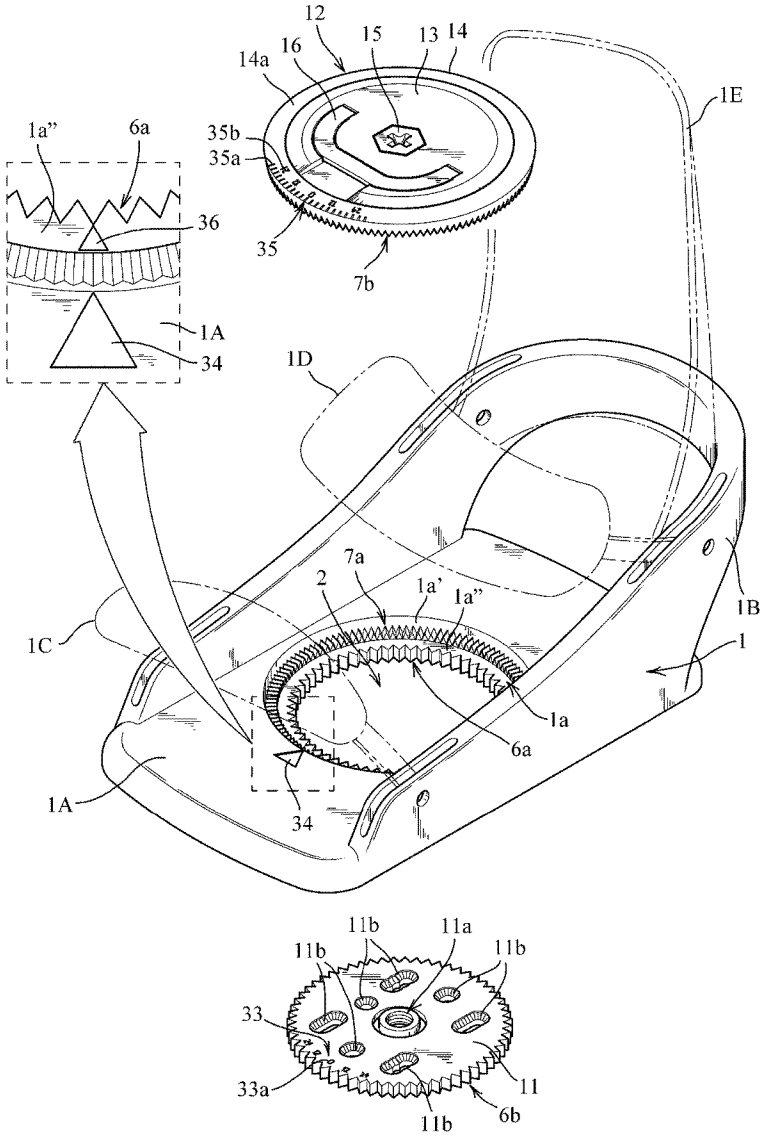
FIG. 9 is an exploded perspective view showing example 2.
Figure 10:
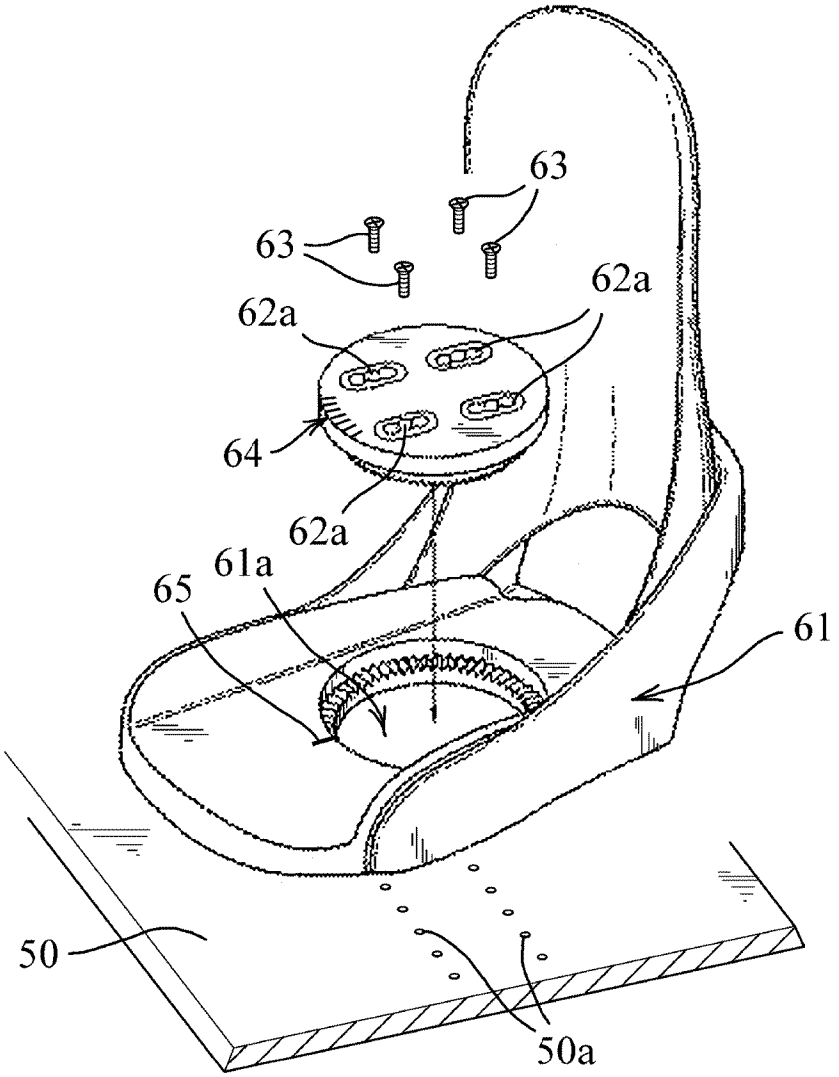
FIG. 10 is a schematic diagram of a binding for a snowboard proposed from the prior art.
Figure 11:
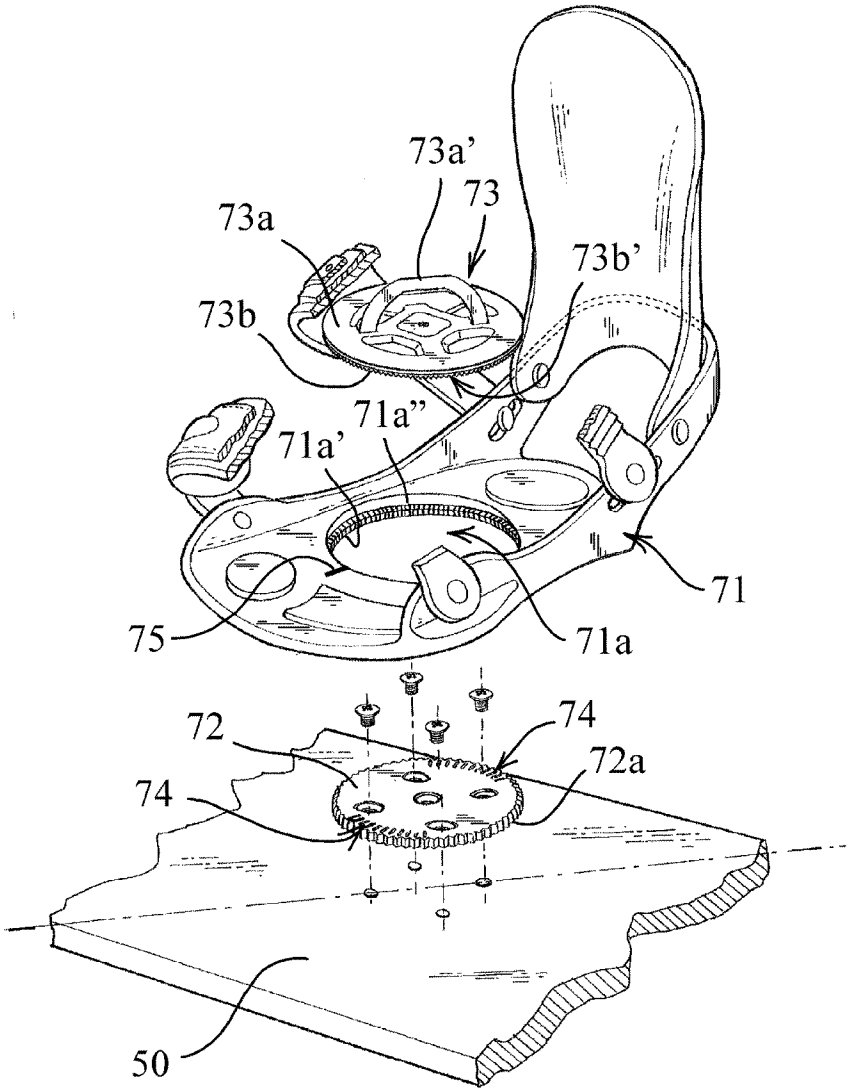
FIG. 11 is a schematic diagram of a binding for a snowboard proposed from the prior art.

As shown in FIG. 9, the angle guide 34 is located on the peripheral edge of the hole section 2 and is configured such that a triangular section is provided at a position where the angle guide 34 is not concealed by the restricting securing body 12.

In the present example, an auxiliary angle guide 36 is located inward from the angle guide 34 and is provided to a bottom surface 1*a*" of a step part 1*a*.

The auxiliary angle guide 36 is configured such that when the hole section 2 in the foot-securing body 1 is fitted onto the disc body 11 using the auxiliary angle guide 36 as an indicator, the angle of the first angle display part 33 for which the auxiliary angle guide 36 is used as an indicator will be the angle at which the foot-securing body 1 is attached to the sliding board 50.

Specifically, as shown in FIG. 9, the auxiliary angle guide 36 is configured such that a triangular section serving as a guide is provided to the bottom surface 1*a*" of the step part 1*a*, which is at a position near the periphery of the hole section 2, and such that a desired angle of the first angle display part 33 is indicated, said angle being the same angle as that of the angle guide 34.

Therefore, although it is also permissible to use only the angle guide 34 described previously, using the auxiliary angle guide 36 makes it possible to match an angle more accurately due to the auxiliary angle guide 36 being located at a position closer to the first angle display part 33 than that of the angle guide 34.

As shown in FIG. 9, the first angle display part 33 is configured to display numeric characters 33*a* at the peripheral edge of the upper surface of the disc body 11. The first angle display part 33 may instead display only angle marking lines or display a combination of the numeric characters 33*a* and angle marking lines.

As also shown in FIG. 9, the second angle display part 35 is configured to display angle marking lines 35*a* and numeric characters 35*b* on an upper surface of a surrounding part 14*a* of a securing member 14 pertaining to the restricting securing body 12. The second angle display part 35 may instead display only the angle marking lines 35*a* or display only the numeric characters 35*b*.

Example 2 is otherwise similar to example 1.

The present invention is not limited to examples 1 and 2; the specific configurations of constituent elements in the present invention can be designed as appropriate.

KEY

1 Foot-securing body
1*a* Step part
1*a*' Inner peripheral surface
2 Hole section
3 Angle guide
4 Angle display part
5 Angle pointing part
7 Rotation-preventing part
10 Attachment fixture
11 Disc body
12 Restricting securing body
13 Base member
14 Securing member
33 First angle display part
34 Angle guide
35 Second angle display part
50 Sliding board

The invention claimed is:

1. A binding for a sliding board, the binding comprising a foot-securing body for securing a foot, and an attachment fixture for attaching the foot-securing body to a sliding board, wherein the binding is characterized in that: the attachment fixture is composed of a disc body that is fastened to an upper surface of the sliding board, a hole section formed in the foot-securing body being non-rotatably fitted onto the disc body, and a restricting securing body that links to the disc body via the hole section in the foot-securing body to restrict and secure the foot-securing body; the disc body is provided with an angle guide; the periphery of the hole section in the foot-securing body is provided with an angle display part; the angle display part is configured such that when the hole section in the foot-securing body is fitted onto the disc body using the angle guide as an indicator, the angle of the angle display part for which the angle guide is used as an indicator will be the angle at which the foot-securing body is attached to the sliding board; and the restricting securing body is provided with an angle pointing part for pointing to the angle display part, wherein the restricting securing body is composed of a base member configured to be linked to the disc body by being rotated, and a securing member provided to the base member so as to be capable of rotating relatively therewith about the same center of rotation, the securing member being provided with the angle pointing part.

2. The binding for a sliding board according to claim 1, characterized in that when the restricting securing body is linked to the disc body by being rotated, a rotation-preventing part for preventing the securing member from rotating is provided between the securing member and the foot-securing body.

3. The binding for a sliding board according to claim 2, characterized in that the periphery of the hole section is provided with an annular step part into which the securing member is fitted, and an inner peripheral surface of the step part is configured to be downwardly inclined toward the hole section.

4. The binding for a sliding board according to claim 1, characterized in that the periphery of the hole section is provided with an annular step part into which the securing member is fitted, and an inner peripheral surface of the step part is configured to be downwardly inclined toward the hole section.

5. A binding for a sliding board, the binding comprising a foot-securing body for securing a foot, and an attachment fixture for attaching the foot-securing body to a sliding board, wherein the binding is characterized in that: the attachment fixture is composed of a disc body that is fastened to an upper surface of the sliding board, a hole section formed in the foot-securing body being non-rotatably fitted onto the disc body, and a restricting securing body that links to the disc body via the hole section in the foot-securing body to restrict and secure the foot-securing body; the disc body is provided with an angle guide;

the periphery of the hole section in the foot-securing body is provided with an angle display part, the angle display part is located on a peripheral edge of the hole section and is provided at a position where the angle display part is not concealed by the restricting securing body;

the angle display part is configured such that when the hole section in the foot-securing body is fitted onto the disc body using the angle guide as an indicator, the angle of the angle display part for which the angle guide is used as an indicator will be the angle at which the foot-securing body is attached to the sliding board; the restricting securing body is provided with an angle pointing part for pointing to the angle display part; furthermore, the restricting securing body is composed of a base member configured to be linked to the disc body by being rotated, and a securing member provided to the base member so as to be capable of rotating relatively therewith about the same center of rotation, the securing member being provided with the angle pointing part.

6. The binding for a sliding board according to claim 5, characterized in that when the restricting securing body is linked to the disc body by being rotated, a rotation-preventing part for preventing the securing member from rotating is provided between the securing member and the foot-securing body.

7. The binding for a sliding board according to claim 6, characterized in that the periphery of the hole section is provided with an annular step part into which the securing member is fitted, and an inner peripheral surface of the step part is configured to be downwardly inclined toward the hole section.

8. The binding for a sliding board according to claim 5, characterized in that the periphery of the hole section is provided with an annular step part into which the securing member is fitted, and an inner peripheral surface of the step part is configured to be downwardly inclined toward the hole section.

9. A binding for a sliding board, the binding comprising a foot-securing body for securing a foot, and an attachment fixture for attaching the foot-securing body to a sliding board, wherein the binding is characterized in that: the attachment fixture is composed of a disc body that is fastened to an upper surface of the sliding board, a hole section formed in the foot-securing body being non-rotatably fitted onto the disc body, and a restricting securing body that links to the disc body via the hole section in the foot-securing body to restrict and secure the foot-securing body; the periphery of the hole section in the foot-securing body is provided with an angle guide; the disc body is provided with a first angle display part; the first angle display part is configured such that when the hole section in the foot-securing body is fitted onto the disc body using the angle guide as an indicator, the angle of the first angle display part for which the angle guide is used as an indicator will be the angle at which the foot-securing body is attached to the sliding board; and the restricting securing body is furthermore provided with a second angle display part configured to display the same angle as the first angle display part indicated by the angle guide.

10. The binding for a sliding board according to claim 9, characterized in that the angle guide is located on a peripheral edge of the hole section and is provided at a position where the angle guide is not concealed by the restricting securing body.

11. The binding for a sliding board according to claim 10, characterized in that the restricting securing body is composed of a base member configured to be linked to the disc body by being rotated, and a securing member provided to the base member so as to be capable of rotating relatively therewith about the same center of rotation, the securing member being provided with the second angle display part.

12. The binding for a sliding board according to claim 11, characterized in that when the restricting securing body is linked to the disc body by being rotated, a rotation-preventing part for preventing the securing member from rotating is provided between the securing member and the foot-securing body.

13. The binding for a sliding board according to claim 12, characterized in that the periphery of the hole section is provided with an annular step part into which the securing member is fitted, and an inner peripheral surface of the step part is configured to be downwardly inclined toward the hole section.

14. The binding for a sliding board according to claim 11, characterized in that the periphery of the hole section is provided with an annular step part into which the securing member is fitted, and an inner peripheral surface of the step part is configured to be downwardly inclined toward the hole section.

15. The binding for a sliding board according to claim 9, characterized in that the restricting securing body is composed of a base member configured to be linked to the disc body by being rotated, and a securing member provided to the base member so as to be capable of rotating relatively therewith about the same center of rotation, the securing member being provided with the second angle display part.

16. The binding for a sliding board according to claim 15, characterized in that when the restricting securing body is linked to the disc body by being rotated, a rotation-preventing part for preventing the securing member from rotating is provided between the securing member and the foot-securing body.

17. The binding for a sliding board according to claim 16, characterized in that the periphery of the hole section is provided with an annular step part into which the securing member is fitted, and an inner peripheral surface of the step part is configured to be downwardly inclined toward the hole section.

18. The binding for a sliding board according to claim 15, characterized in that the periphery of the hole section is provided with an annular step part into which the securing member is fitted, and an inner peripheral surface of the step part is configured to be downwardly inclined toward the hole section.

* * * * *